United States Patent [19]

Berthelsen et al.

[11] 4,394,207

[45] Jul. 19, 1983

[54] APPARATUS FOR SEALING THE VALVE IN A VALVE BAG

[75] Inventors: Ernst R. Berthelsen, Terndrup; Christian Hejlesen, Vadum, both of Denmark

[73] Assignee: Bates Ventilsaekke Co. A/S, Nørresundby, Denmark

[21] Appl. No.: 352,767

[22] Filed: Feb. 26, 1982

[30] Foreign Application Priority Data

Mar. 3, 1981 [DK] Denmark ..... 946/81

[51] Int. Cl.[3] ..... B65B 7/02

[52] U.S. Cl. ..... 156/578; 53/383; 118/317; 118/323; 118/504; 156/357; 156/443

[58] Field of Search ..... 118/300, 306, 317, 504, 118/323; 53/383, 371, 373, 375; 156/578, 356, 357, 443

[56] References Cited

U.S. PATENT DOCUMENTS

| | | | |
|---|---|---|---|
| 2,996,858 | 8/1961 | Swenson | 53/383 X |
| 3,191,360 | 6/1965 | Meissner | 53/383 |
| 3,555,778 | 1/1971 | Kapave | 53/383 X |
| 3,574,271 | 4/1971 | Andersson | 53/383 X |

*Primary Examiner*—David A. Simmons
*Attorney, Agent, or Firm*—Edward F. Levy

[57] ABSTRACT

Apparatus to seal the valve of a valve bag with adhesive and of the kind where bag arrives from bagging machine standing up or somewhat reclining. The apparatus comprises adhesive sprayer (9) over which and fitted thereto a shield (23) with bow-shaped cross-section and rounded front is mounted so that the fronts of shield (23) and sprayer (9) are flush over and under each other, or so that the shield (23) protrudes in front of sprayer (9). The assembly comprising shield (23) and sprayer (9) is suspended or has organs to move it in a way that the assembly during insertion into the valve (6) describes a bow-shaped motion (A) in the vertical middle of the bag valve and so that the assembly lifts up the valve (6) when inserted. The adhesive sprayer (9) is designed to apply adhesive onto the lower inside of the bag valve (6).

According to one special embodiment the adhesive sprayer can turn or rotate round its own axis in order to apply a consistent strip of adhesive. After the adhesive has been applied to the valve a piston member compresses the valve from above in order to close the valve. Besides, there may be a sensory organ incorporated in the shield so as to ensure that adhesive is applied only after proper insertion of the adhesive sprayer into the valve of the bag.

The apparatus ensures that the adhesive sprayer is properly inserted into the valve as the valve is opened and distended by the shield prior to the process, and in addition the sprayer will be placed at exactly the same spot every time it enters a valve due to its being fixed to the guiding shield.

10 Claims, 12 Drawing Figures

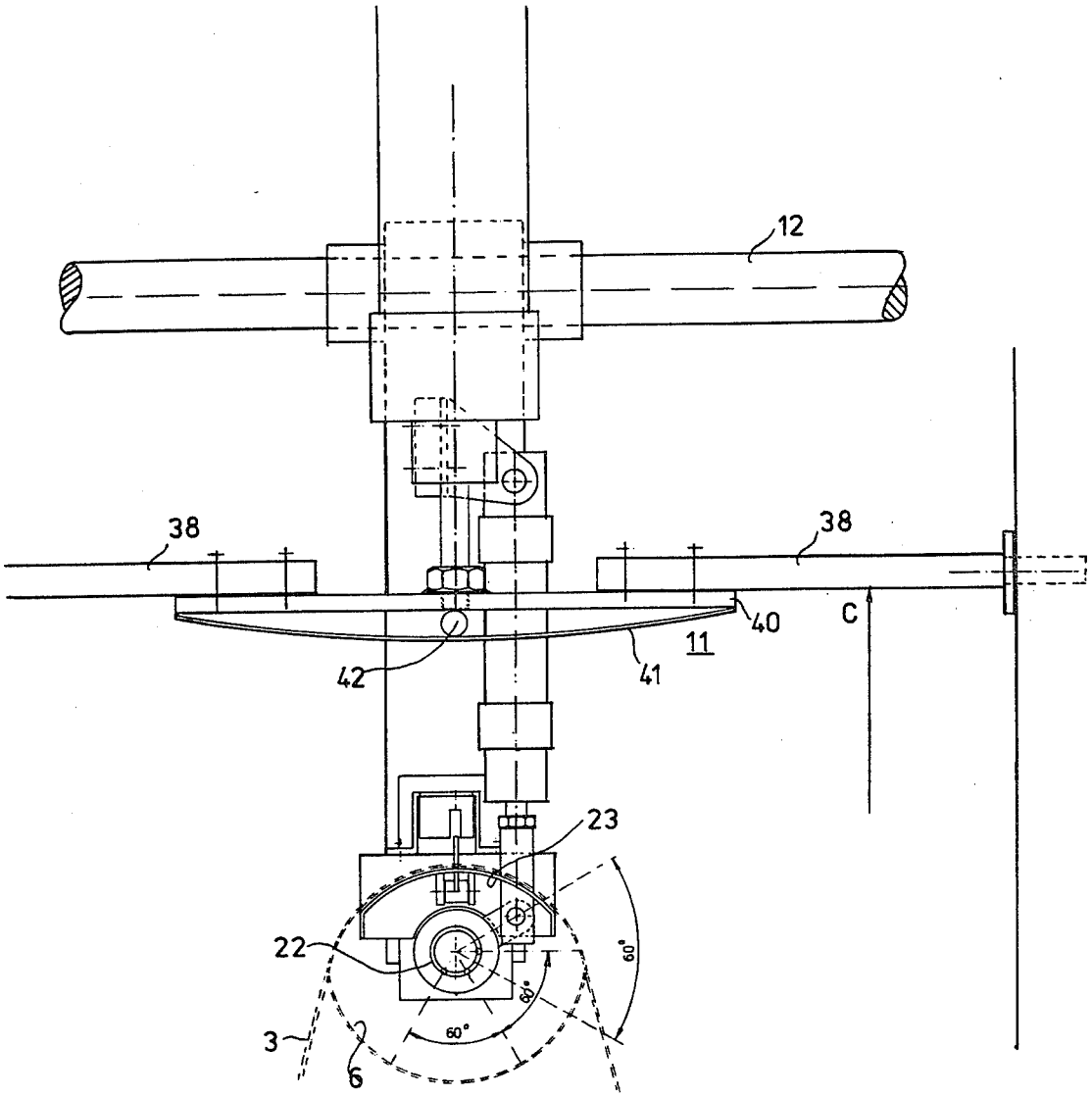
FIG. 3
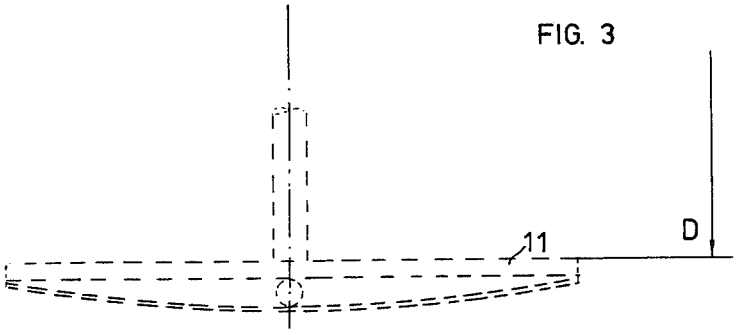

APPARATUS FOR SEALING THE VALVE IN A VALVE BAG

This present invention is concerned with an apparatus designed to seal with an adhesive the valve portion of a valve bag and is of the kind where the bags arrive from a filler machine in a vertical or reclining position, and which features an adhesive gun designed to enter inside the bag valve there to apply a certain quantity of adhesive onto the inside of the valve and then to withdraw from the bag valve, and also comprises a piston member designed to descend on, press down and seal the valve after due application of the adhesive.

Valve bags are used for storage and transportation of pulverulent or trickling material such as sugar, flour, grain, feeding pills or pellets and are filled by a machine where the valve of the bag is positioned onto a filling spout, through which an apportioned quantity of the material is fed to each bag. Next the bags are pushed free of the filling spout and onto a conveyor taking it away. The strength of the bags is not sufficient to allow them to hang freely under the filling spout, but they must be supported by a so-called bagging support which may be a short leader profile or a wheel with a groove round its diameter.

A valve bag is made from web in such fashion that the edges of the web are bent round towards the middle where they are glued together so that a holster is formed. Top and bottom are made by folding a portion of the end and at the same time pressing the corners towards the bag, so that one side is brought to lie near the bag and the other side away from it, and where the sides form a triangle with top point at the folding line. The ends of these two pieces are then folded towards each other and are glued, except for the corner which forms the bag valve. Thus the bag valve comes with three sharp folds, i.e. one at each side where the end portions have been folded, and one in the middle where the valve enters the bag. Because of these sharp foldings, and because the valve is thoroughly compressed, it will never unless forced to do so form a circular opening or mouth, but will on account of the foldings try to regain its original shape. This means that, when the bag is pushed free of the filling spout, the cross-section of the valve will no longer be circular but will contract, or rather the upper surface of the valve will be pulled down, as the sideways pressure from the material in the bag will pull outward the side edges of the valve. The cross-section of the valve would the typically be similar to two intersecting arcs. Besides it should be held in mind that the whole construction of a valve bag is designed to make it self-closing. If only for the above reasons is it difficult to insert a spray gun into a bag valve using an apparatus of the kind initially described.

The tendency of the bags to fold up and to arrive with a range of different apertures of the valves is furthered by the settling and shifting of the bag when it is pushed free of the filling spout and onto the conveyor, and also when it is freed of the tension it has been subjected to during bagging.

Another aspect which makes it difficult to insert a spray gun in a bag valve is that the distance from the bottom of the bag to the center of the valve is not a well-defined distance. This is not so much due to variations of the lengths of bags occurring during production, as this can be kept within fairly narrow limits at the factory, but rather that the bag settles, i.e. sags when it is pushed free of the filling spout and onto the conveyor.

Another thing is that certain bagging machines are provided with a vibrator on the bagging support in order to vibrate the material into position. On that type of machine the lower corner under the bag valve tends to crawl towards the machine and gets slightly deformed, which causes even more variation of the height of the bag.

All the above influences make it extremely difficult to automate the insertion of an adhesive sprayer in a bag valve.

From German Description no. 1,194,313 we know an apparatus of the kind mentioned in the introduction where the spray gun is placed on a swivel arm turning round a vertical axis horizontally. Because of the above-mentioned variations of bag height and uneven degrees of valve apertures the spray gun of that apparatus does not penetrate the bag valve with adequate certainty. Even if it is easier to position the bags laterally with increased exactness the apparatus still does not take into account the risk of the spray gun not entering the middle portion of the valve, but one of the sides of the opening. As already mentioned the cross-section of the valve opening is roughly similar to two intersecting arcs. Thus the height of the actual valve opening decreases rapidly towards the edges. Even if the spray gun could have penetrated when arriving at the middle it is by no means certain that this is the case when entering or arriving near one of the sides. Another thing is that the German apparatus does not apply adhesive to the entire width of the valve if the spray gun enters near one of the sides. Besides, there is the added risk of fouling of the adhesive sprayer as it may drag against the applied adhesive on its way out of the valve.

The scope of this present invention is to indicate and describe an apparatus of the kind mentioned above but where the spray gun is certain to penetrate into the bag valve and is placed therein consistently and in the same position irrespective of variations of bag height or shape of valve opening or aperture.

According to this invention this is achieved by placing over and connecting to the adhesive spray a guiding shield with rounded front, which is bow-shaped when seen on a cross-section, in such a way that the fronts of the shield and the sprayer concur horizontally or that the shield protrudes to some extent, and where the assembly of shield and sprayer is suspended or has operating members so that the assembly during penetration into the bag valve describes a curved movement along the plane of the bag in such a way that the assembly when entering also lifts up the valve, and where the adhesive sprayer is designed to apply the adhesive to the lower side of the bag valve. In that the guiding shield during its curved motion arrives from below at the same time as it is inserted in the valve, the shield will lift up the upper portion of the valve so as fully to distend same. The shield can be inserted relatively far down the mouth of the bag valve so that it will catch under the upper portion of the valve even if it is folded up or the bag height relatively small so that the valve is low. In the course of insertion the bag valve also adjusts sideways onto the guiding shield. Being fixed to the shield, the adhesive sprayer will thus take a consistent position inside the valve because of the intermesh of valve and shield. The reliable positioning and opening of the bag valve and the resulting possibility of precise application of adhesive to a clearly defined section of the bag valve has the effect that the present invention can be used in connection with the cheapest form of valve bag, i.e. without any kind of extension of the valve, and besides it is avoided that the adhesive could mix with the contents of the bag.

The curve-shaped motion of the assembly of shield and sprayer may be achieved in various ways. It may be composed of two translative motions at right angles to each other. For that purpose, air or hydraulic cylinders may be used. The simplest method, however, is to suspend the assembly on a swivel arm which can rotate on a vertical axis positioned over the bag, so that the assembly follows a flat circular motion into the bag valve. The section of the curve that the assembly describes during insertion into the bag valve should not be too crookedso that the shield forms a too steep angle with the upper portion of the valve, but it should not be too flat either so as to cause the shield to enter the valve along an approximately right line. In case the curve is a segment of a circle, which would apply if the shield is mounted on a swivel arm, it has proved ideal that the radius of the circle is from $2\frac{1}{2}$ to 6 times the height of the valve when distended.

As for the detailed design of the guiding shield it should be determined by the form of the bag valve, but an ideal embodiment would be one where the shield is rectilinear but with the surface of the front slightly bent downwards, the length $\frac{1}{2}$ to 1 times the height of the distended valve, the width 0.85 to 0.50 times the width of the distended valve.

Another consideration is that the adhesive must not mix with the contents of the bag, which risk occurs if the sprayer is not positioned exact inside the valve and, if at the same time, an adhesive sprayer is used which spreads the adhesive all over the valve as shown in the above-mentioned German Description No. 1 194 313. This present invention reduces the risk of having the adhesive mixed with the contents of the bag firstly for the reason that the adhesive sprayer is inserted at exactly the same spot time and again, and at the approximate center line of the valve. It is, however, possible to reduce further the above risk, and at the same time to protect the position of the adhesive sprayer, namely by withdrawing somewhat the adhesive sprayer in relation to the front of the shield inside the curved motion that the front portion of the guiding shield describes during insertion into the valve, and by applying the adhesive along a forwardly slanting path. In that case the adhesive may be applied as near the mouth of the valve as is in any way possible. If placing the adhesive sprayer in that fashion it can be avoided that it touches bag valve or inside surfaces at all, so that the risk of incrustation is nonexistent. An even more expedient method would be to apply a strip of adhesive across the inside of the valve, which method, apart from the economies effected based on the immense number of bags, would preclude altogether mixture of adhesive with the contents of the bag, as the width of such a strip is minimal as compared with the length of the valve, but still ensuring a complete sealing of the valve of the bag. According to the invention this is achieved by suspending the adhesive sprayer pivotably round its longitudinal axis, and also providing it with one or several nozzles issuing a consistent spray, and providing a device to turn the sprayer so that it will deliver a consistent strip of adhesive over at least half of the diameter of the inside of the valve, preferably somewhat more. The rotating motion of the sprayer may be brought about in various ways, possibly with an electric motor, or rack-and-pinion, chain drive, or various other embodiments. Ideally, however, the sprayer embodiment should include three nozzles placed at intervals of 60°, and with the sprayer designed to rotate 60° by means of an extending arm connected to a pneumatic cylinder.

Even under ideal conditions situations are bound to arise, where the guiding shield does not catch under the valve, which may be due to the bag having overturned, defective valve, or other causes. In order to prevent the sprayer from applying adhesive onto the bag in such a case, and to notice the operators that the bag was not glued, the upper surface of the shield incorporates a sensor designed for activation by the wall of the valve, which sensor is connected with the adhesive sprayer in order to activate application. There are various ways of doing this, inter alia by letting the sensor activate an adhesive valve only, or that the adhesive sprayer should at the same time be in its extreme position. The alarm may be a source of light or sound. The sensor may be purely mechanical, or a photo-cell. Ideally it could be a spring-loaded rocker switch protruding up through the surface of the guiding shield through a slot at the front of the shield.

The piston member designed to compress the valve after proper application of adhesive can be positioned at a distance from the assembly consisting of sprayer and shield in such a way that the bags are taken or conveyed to the piston member after application of adhesive. If they are positioned together in line the space would be rather cramped, especially if sprayer and shield are mounted on a swivel arm over the bag. In this case the apparatus is designed so as to guide the piston member in a guideway, and in its withdrawn position somewhat removed backwards in relation to the bag valve.

One embodiment of the present invention will now be described by way of example with reference to the accompanying drawings, in which:

FIG. 1 is a schematic drawing of a bagging machine for valve bags and one embodiment of the apparatus according to the invention designed to glue the valve of a valve bag with an adhesive, FIG. 2 is the apparatus shown on a larger scale, seen from the side, and with the adhesive sprayer inserted in a bag valve, FIG. 3 same as FIG. 2 but seen from the front, i.e. seen from the bag valve, FIG. 4 is the apparatus in FIGS. 2 and 3 with suspension, seen from the side, but shown without guiding shield over sprayer and piston member, and without indication of valve bag, FIG. 5 same as FIG. 4, but seen from the front.

Figure 10:
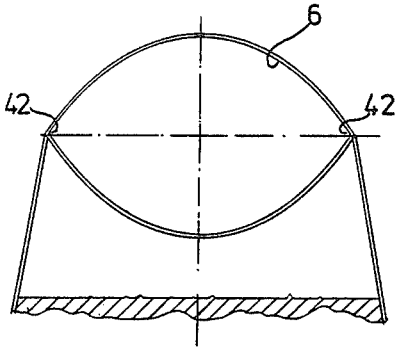
Figure 11:
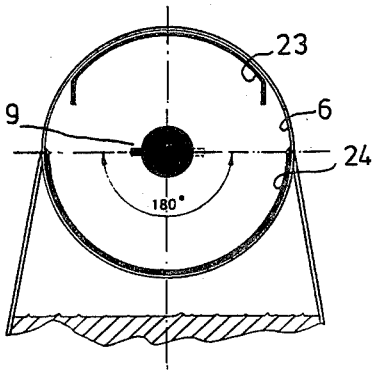
Figure 12:
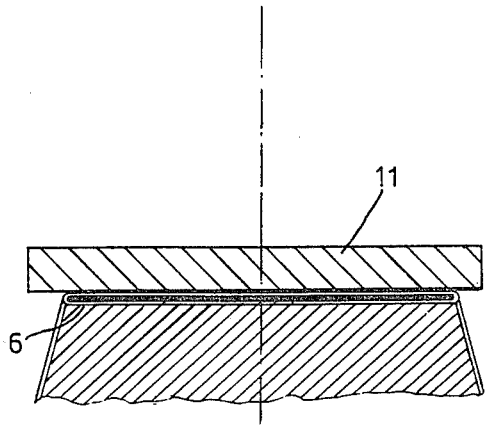

FIG. 10 cross-section of valve after it is freed of the filling spout,

FIG. 11 cross-section through bag valve and shield and adhesive sprayer, and FIG. 12 cross-section through bag valve in the process of being pressed together by piston.

Figure 1:
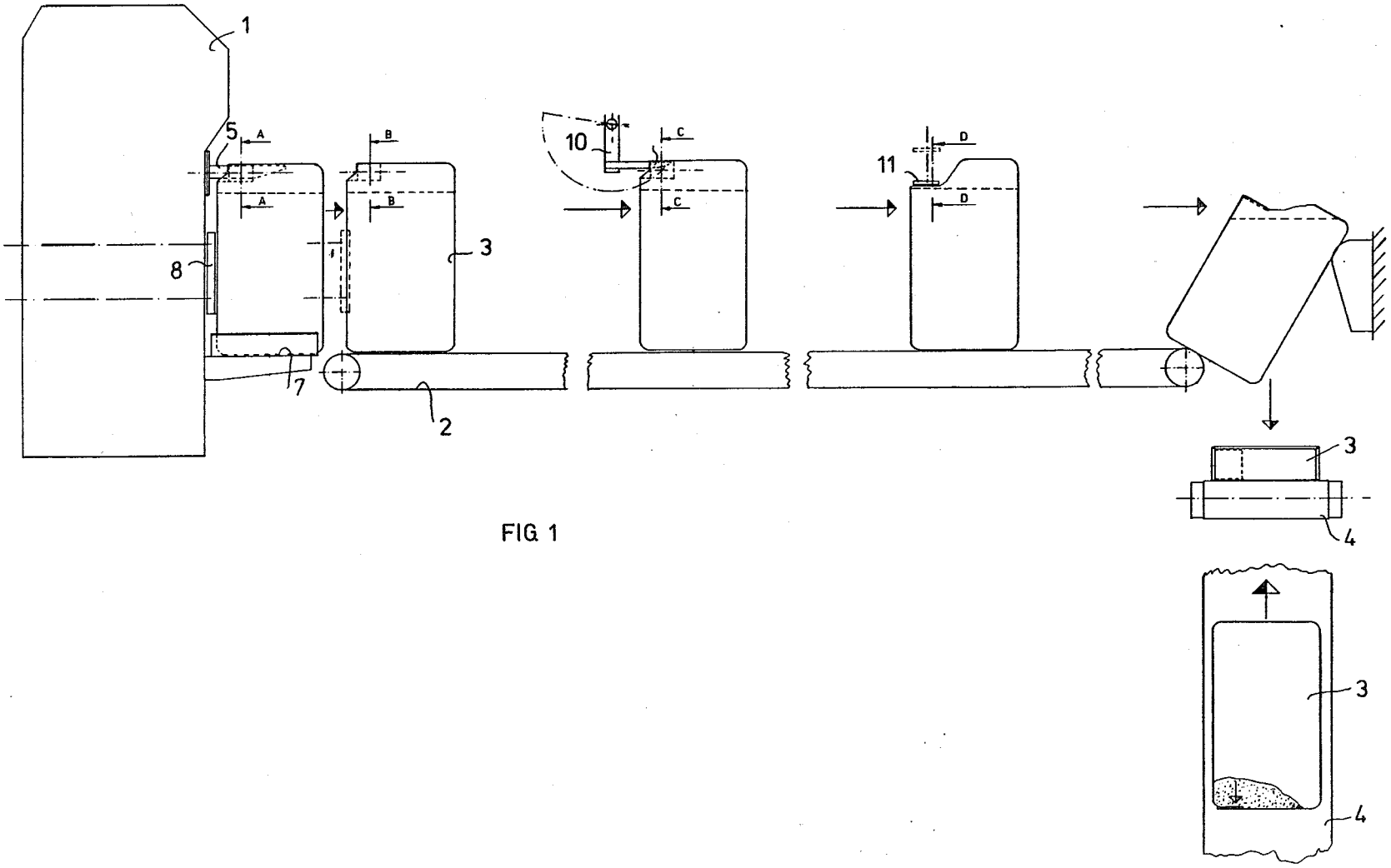

FIG. 1 shows a filling or bagging machine 1 and a conveyor 2 at right angles to the machines, which conveyor delivers bags 3 onto another underlying conveyor 4 running across the track of conveyor 3.

The empty bags are fed onto the filling spout 5 of the bagging machine by an already known fitting device (not shown). Under the filling spout 5, at a distance from its longitudinal axis corresponding to the distance between the longitudinal axis of the valve 6 and the bottom of the bag when filled, a bagging support 7 is provided, made of sheet bent so as to form a groove. The groove forms a foot base on the bag in that the groove has a cross-section similar to the cross-section of the base occurring if you place a valve bag on a surface.

The conveyor 2 leading away from the bagging machine 1 is level with the bagging support to minimise impacts and shocks which might cause the bag to sag when the bag shifts or changes position in line, and the bag is pushed onto the conveyor 2 by a piston 8 mounted in front of the conveyor on the bagging machine 1.

Ideally, the piston would be a pneumatic or hydraulic cylinder, activated by the bagging machine so as to push away the bag when the apportioned quantity of material has been delivered, and reciprocating.

When the bag enters the conveyor 2 it activates the driving mechanism of the belt and the bag is taken to a stop where closing is to take place. In this position an adhesive sprayer 9 is suspended in front of and over the bag from or on a swivel arm 10 which is activated when the bag stops, swinging down and into the bag valve there to apply a strip of adhesive, after which it returns to its original position.

Still with the bag standing still in the same position, but with the swivel arm having returned to its original position, a piston member 11 is activated to press or clamp down onto the valve and sealing it using the contained material as support. For the sake of clarity the situation is shown transposed from the insertion of the adhesive sprayer in the valve.

After pressure has been exerted on the valve the conveyor belt 2 starts again, taking the bag to the transverse conveyor 4.

Figure 4:
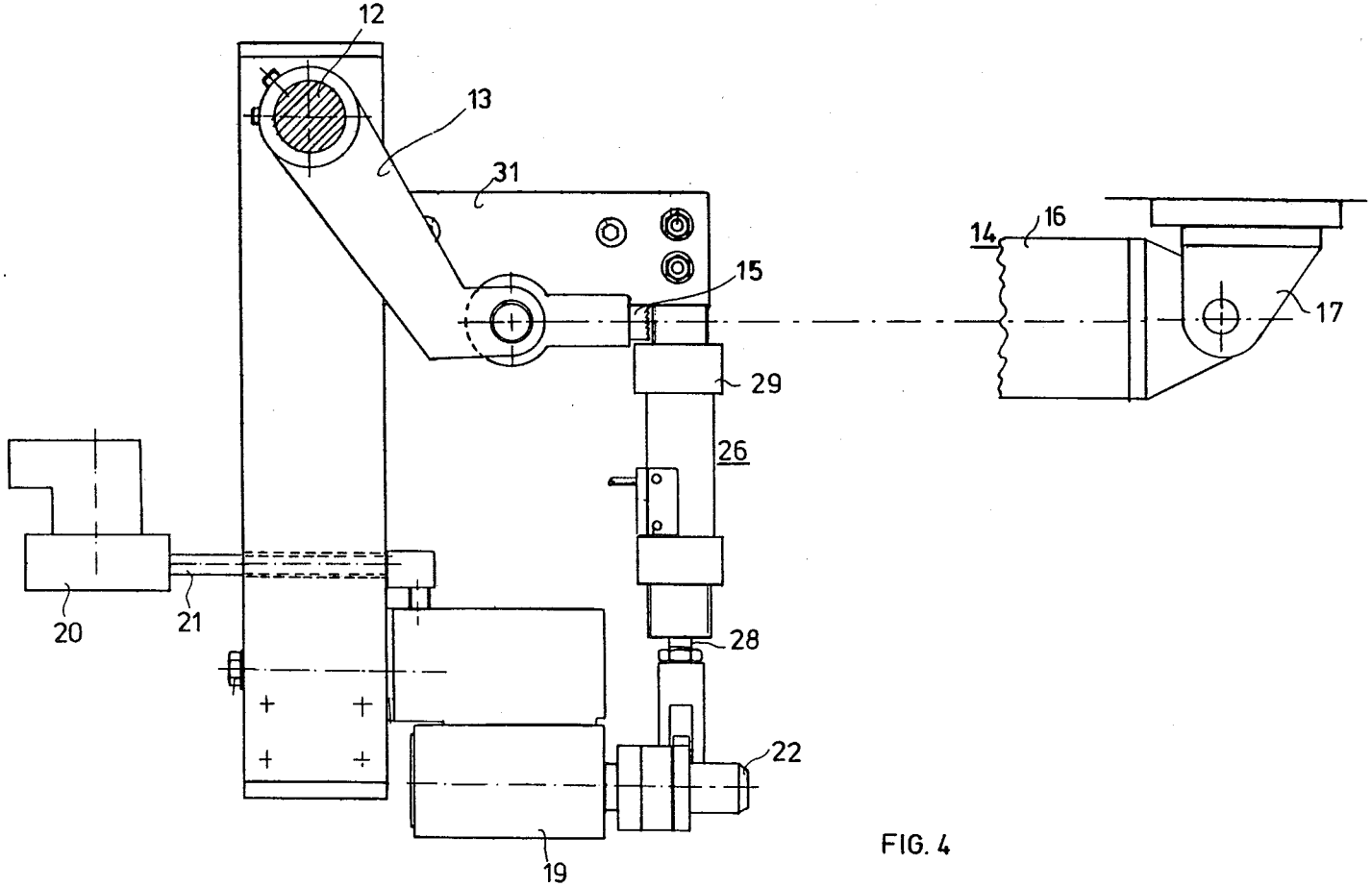
Figure 5:
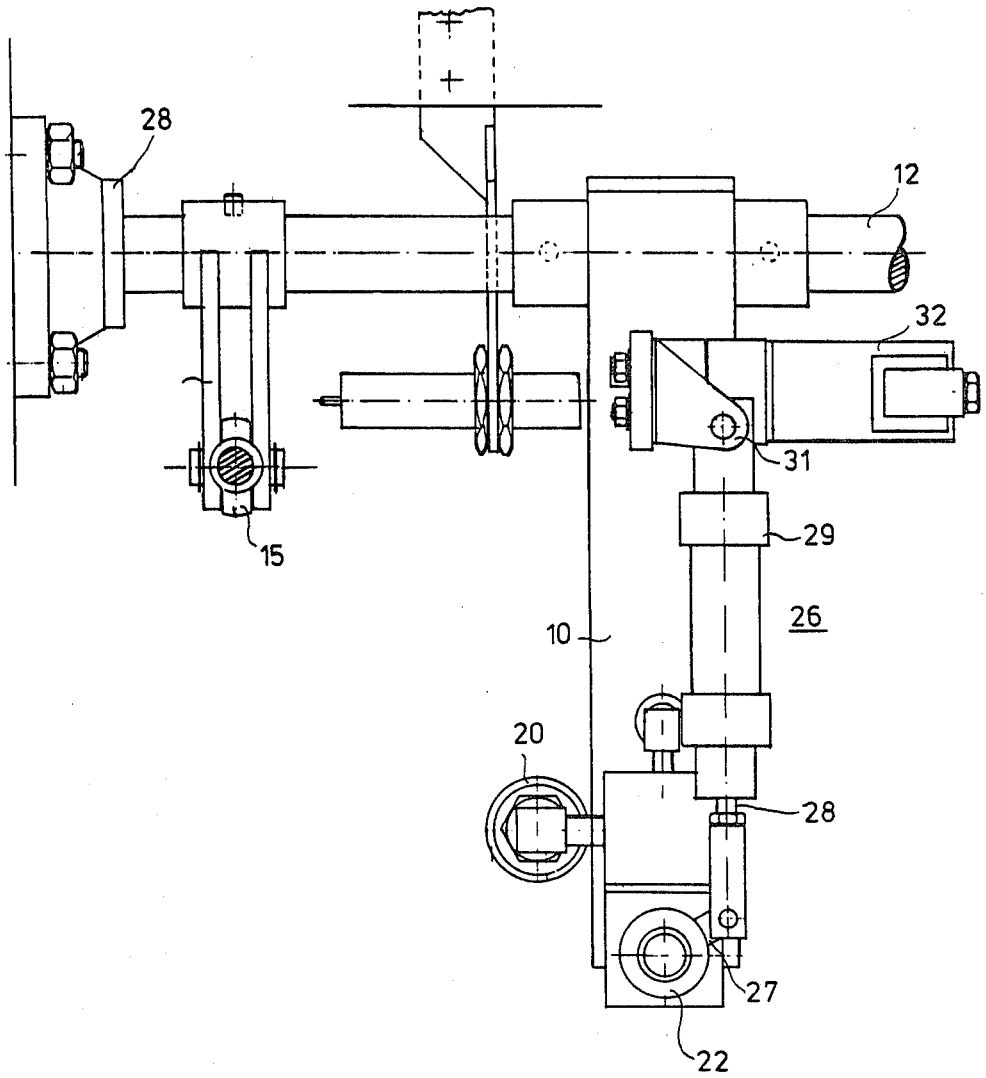

The attached drawings FIGS. 2–5, but esp. FIGS. 4 and 5 show the adhesive sprayer mounted on a swivel arm 10 which is again fitted to an axle 12 above the bag lying at right angles to the vertical plane of the bag valve. To rotate the swivel arm 10 there is an arm 13 fitted to the axle 12, on which arm 13 an air cylinder 14 is mounted so that the cylinder piston or ram rod is fitted to the arm 13, and the cylinder housing 16 with fittings 17 to a frame not shown. The axle 12 of the swivel arm is mounted on the same frame, at each end resting in bearings 18 fitted to the frame.

The actual spray gun or adhesive sprayer 9 comprises a hot-melt gun 19 of an already known design fitted at the lower end and at right angles to the swivel arm 10. The hot-melt gun 19 is connected to the remaining hot-melt equipment by a hose 20 and a solenoid valve 21. The additional hot-melt equipment comprising melting tank, pump, and possibly a filter, is mounted on the mentioned frame not shown.

Figure 6:
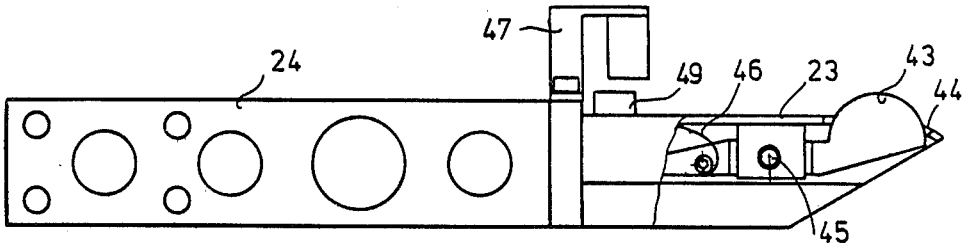
FIG. 6 is the guiding shield seen from the side.

Above the adhesive sprayer 9, in particular above the nozzle head 22, a shield is mounted, which shield is also fitted to the lower end of the swivel arm 10 by means of a couple of backward protruding legs 24. The guiding shield 23 protrudes so much in front of nozzle head 22 that the head lies behind the curve described by the front edge of the shield when it penetrates the bag valve. The shape of the guiding shield 23 will appear from FIGS. 6–8. It can be seen that otherwise the shield is rectilinear and with a rounded front, slightly bent downwards, and that the shield has a bow-shaped cross-section and vertical sides 25. The described design of the guiding shield 23 has proved very suitable for the functions of opening, distending and catching under the bag valve 6.

Figure 2:
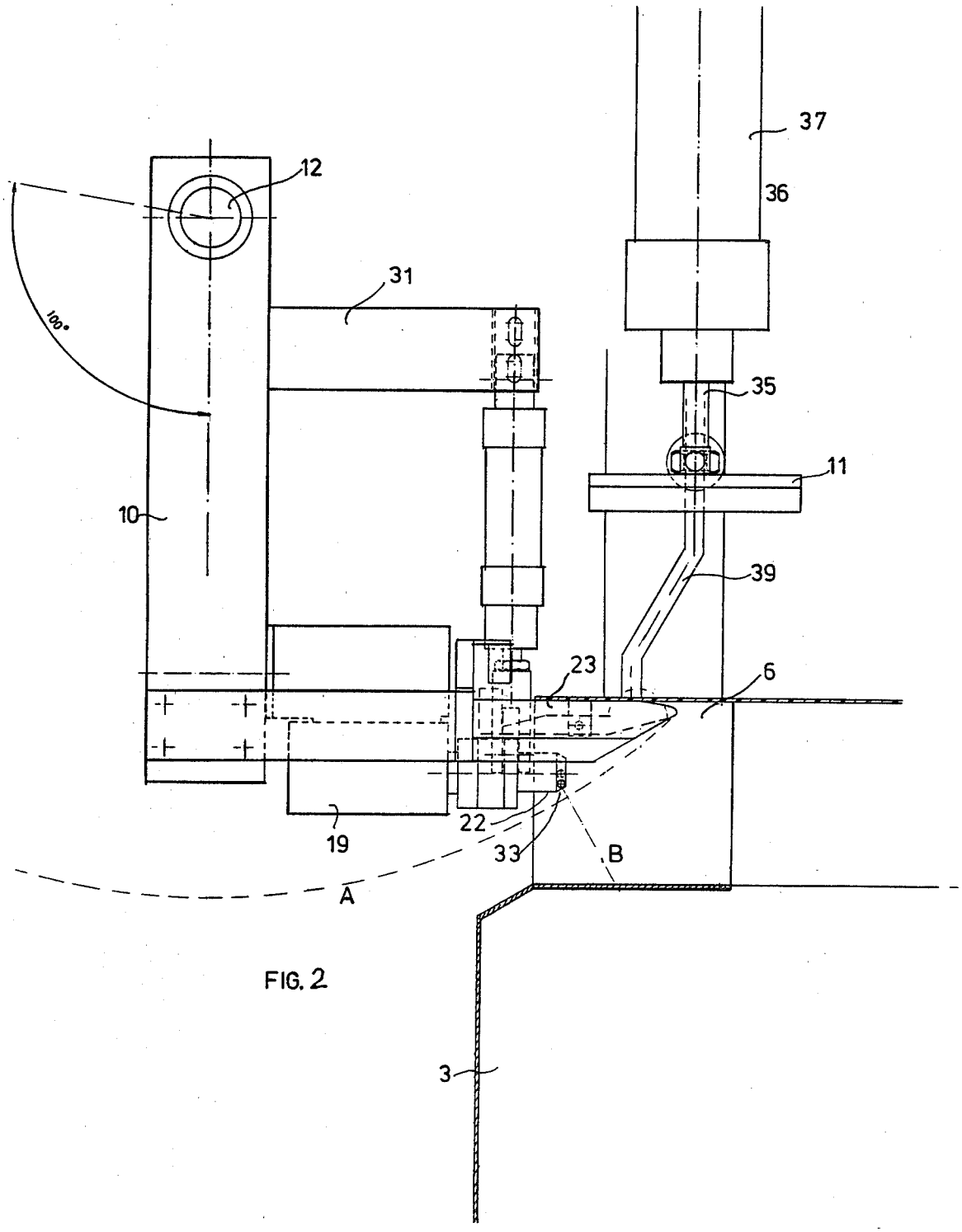

With reference to FIG. 2 of the drawing the length of swivel arm 10, the distance from front of shield 23 to swivel arm 10, and the position of the axle 12 round-which the swivel arm 10 turns, have been matched so as to achieve that, from a retracted vertically suspended position where the swivel arm 10 is a bit above the horizontal plane, the front of the shield 23 will swing or swivel down so that the shield 23 enters a circular arc A as indicated by a dotted line, coming from below and simultaneously catching under and lifting up the upper portion of the bag valve 6 so as to fully distend the valve.

The nozzle head 22 of the adhesive sprayer is pivotably mounted round its own longitudinal axis in the hot-melt gun 19. The nozzle head 22 can be brought to rotate through a pneumatic cylinder 26 in the way that the head 22 has a small arm 27 fitted in a fork on the ram rod 28 of the cylinder, and where the cylinder housing 29 via mountings 30 is fitted to an arm 31 protruding from swivel arm 10. Cylinder 26 is controlled by an air valve 32. The nozzle head 22 has three nozzle openings 33 placed on a circle with 60° space in between, and where the nozzle head 22 can be rotated 60° by means of cylinder 26. In the initial position one nozzle 33 points horizontally to the side, and on turning the nozzle head as described a consistent strip 34 of adhesive covering 180° is applied, the nozzle openings emitting a consistent spray. As the nozzle head 22 is positioned a fraction above the center of the bag valve a strip of adhesive is laid out or applied covering a bit more than half of the lower portion of the valve, which method results in perfect sealing of the bag valve along the folding lines already mentioned. As nozzle head 22 is somewhat retracted in relation to the front of guiding shield 23, and as the head thus only just enters the mouth of the valve, the nozzles are so designed as to issue a forwardly inclined spray B. Thus the strip 34 will not be applied along the outer edge of the valve opening, but somewhat down the valve, and yet not so far down as to cause risk of mixture with the contents of the bag. The retracted position of nozzle head 22 is suitable in the way that it will not be subjected to damage or incrustation with adhesive by dragging against the bag valve.

In order to compress the bag valve 6 after the adhesive sprayer 9 has applied the consistent strip of adhesive across the lower portion of the bag valve and has reciprocated the apparatus features a piston member 11 which descends in order to apply pressure onto the bag valve 6. As seen of FIGS. 2 and 3 on the drawings the piston member 11 is mounted on the ram rod 35 of an air cylinder 36 whose housing 37 is fixed on the already mention frame not shown. From each side of the piston member 11 and fixed thereto protrude two bars 38 the ends of which rest in a guideway 39 in order that the piston member 11 is pulled backwards in its retracted position to make room for the adhesive sprayer 9. Otherwise, the piston member is comprised of a sheet of iron 40 on whose underside there is a piece of spring steel 41 downwardly arched by means of a piece of round bar placed between sheet 40 and spring steel 41. This downward arch of the spring steel of piston member 11 has proved to apply pressure to the full length of the bag valve thereby ensuring the sealing of the bag valve. On FIG. 3 the piston member 11 is shown in its upper position C with full lines, and indicated in its D lower position with dotted lines.

Figure 9:
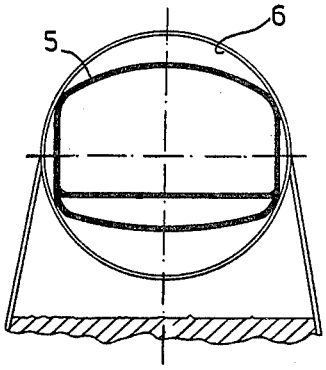
FIG. 9 is a cross-section through bag valve and filling spout.

FIGS. 9–12 of the drawings show a cross-section of the bag valve at the various stages. FIG. 9 shows the form of bag valve 6 when positioned over filling spout 5. FIG. 10 shows one ideal form of the bag valve 6 after it has been pushed free of the filling spout 5, and where two sharp folding lines at the sides of the valve are clearly demonstrated. FIG. 11 shows a cross-section of the valve 6 with shield 23 inserted together with an adhesive sprayer 9 with only one nozzle, and where a strip 24 of adhesive has been applied across the lower portion of the bag valve 6. FIG. 12 of the drawings shows a cross-section of the bag valve at the stage where it is compressed by piston member 11 using the material filled into the bag as support.

Figure 7:
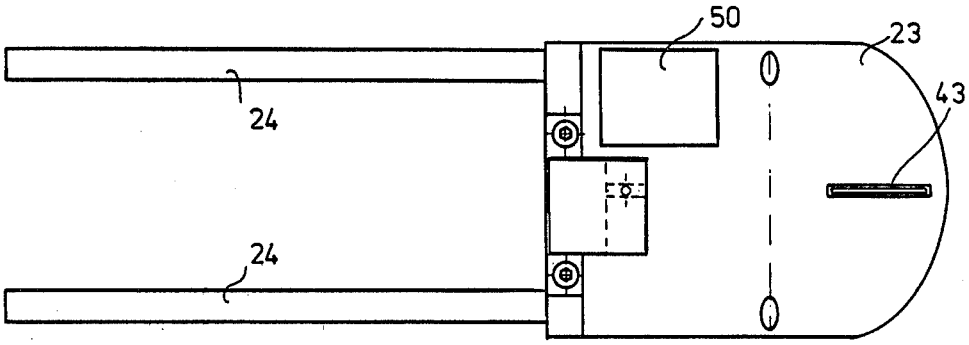
FIG. 7 is the shield as seen from above.
Figure 8:
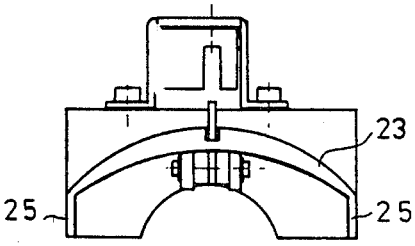
FIG. 8 is the shield seen from the front.

If shield 23 and thereby also adhesive sprayer 9 for some reason unknown should nor penetrate or enter into bag valve 6 the shield 23 features a sensor to check whether the shield enters or goes past the bag valve. The arrangement comprises a switch arm 43 protruding up through a slot 44 made at the front of the shield, and it is pivotably mounted under the shield round an axis 45. Switch arm 43 is kept in position by a coiled spring 46. Over the shield 23 and at its root an inductive sensor 48 is fitted in mountings 47, which sensor is activated by the switch arm 43 in the way that the rear part 49 thereof is so designed as to protrude up through an opening in the shield. The opening 50 at the side of the shield as shown in FIG. 7 is designed for the air cylinder 26 which rotates the nozzle head 22 of the hot-melt gun. When the shield 23 with the sprayer 9 swings inside the bag valve 6 the switch arm 43 is depressed as the shield 23 lifts the upper portion of the valve, activating the inductive sensor 48 to relay a signal to the control unit to release adhesive and turn nozzle head 22. In case the shield 23 does not catch under the valve opening 6 and the switch arm 43 is not activated there may be included an acoustic or visual alarm to signify that the bag in question was not glued.

The present invention has thus been seen to achieve an apparatus which is sure to glue together the bag valve 6 irrespective of variations in valve aperture or bag height, and at the same time eliminating the risk of mixing the glue or adhesive with the contents of the bag.

This is what we claim:

1. An apparatus designed to seal the valve of a valve bag with adhesive, and of the kind where the bags arrive from a bagging machine vertical or somewhat reclining, and which apparatus comprises an adhesive sprayer designed in such fashion that it can be inserted in the bag valve there to apply an apportioned quantity of the adhesive onto the inside of the valve and next be withdrawn, and also comprising a piston member designed so as to apply pressure to the bag valve after the application of adhesive and closing it in the process, characterized in that mounted over and connected to the adhesive sprayer (9) there is an in cross-section bow-shaped shield (23) with rounded front, in such a way that the front ends of shield (23) and adhesive sprayer (9) are flush over and under each other, or that the shield (23) protrudes in relation to the sprayer (9), and where the assembly consisting of adhesive sprayer (9) and shield (23) are suspended or has moving organs in such a way that the assembly during insertion into the bag valve (6) describe a curved motion (A) in the vertical middle of the bag valve, so that when penetrating the bag valve (6) the assembly will lift up the valve, and where the adhesive sprayer (9) is designed to apply adhesive to the lower inside of the bag valve (6).

2. Apparatus according to claim 1, characterized in that adhesive sprayer (9) and shield (23) are mounted on a swivel arm (10) rotating or swinging on a horizontal axle or shaft (12) fitted above the bag.

3. Apparatus according to claim 2, characterized in that the swivel arm (10) is of a length so that the tip of the shield (23) describes a curved segment of a circle (A) with a radius sized $2\frac{1}{2}$–6 times the height of the valve (6) when distended.

4. Apparatus according to claims 1, 2, or 3, characterized in that the shield (23) is otherwise rectilinear, but that the upper portion of the front is slightly downward bent, and has a length of the order $\frac{1}{2}$–1 times the height of the fully distended valve (6) and a width 0.85–0.50 times the width of the valve, also when distended.

5. Apparatus according to claims 1, 2, or 3, characterized in that the adhesive sprayer (9) is withdrawn in relation to the front of the shield (23) inside of the curve (A) described by the front of the shield during insertion into the bag valve (6), and that the adhesive sprayer (9) is so designed as to spray along a forwardly inclined track (B).

6. Apparatus according to claims 1, 2, or 3, characterized in that the adhesive sprayer (9) is pivotably mounted on its longitudinal axis, and that it is provided with one or several nozzles (33) issuing a consistent jet, and also a device to turn the adhesive sprayer (9) so that it applies a consistent strip (24) of adhesive over at least half the diameter of the valve, preferably somewhat more.

7. Apparatus according to claim 6, characterized in that the adhesive sprayer (9) has three nozzles fitted at intervals of 60°, and where the sprayer (9) is designed to move or rotate 60° by means of an arm (27) protruding from the sprayer and an air cylinder (26).

8. Apparatus according to claims, 1, 2 or 3, characterized in that a sensor is fitted in the upper surface of the shield (23) which sensor is designed for activation by the bag valve (6) and is connected to the adhesive sprayer (9) to activate the spray.

9. Apparatus according to claim 8, characterized in that the sensor is a spring-loaded rocker switch (43) protruding up through the surface of the shield through a slot (44) made at the front end of the shield.

10. Apparatus according to claims 1, 2 or 3, characterized in that the piston member (11) is steered or guided in a guideway (38,39) so that, in its withdrawn position, the piston member (11) is retracted in relation to the bag valve (6).

* * * * *